US006026616A

United States Patent [19]

Gibson

[11] Patent Number: 6,026,616

[45] Date of Patent: Feb. 22, 2000

[54] EAVE CLADDING

[76] Inventor: J. W. Gibson, 146 Glassboro Dr., Oak Ridge, Tenn. 37830

[21] Appl. No.: 09/082,020

[22] Filed: May 20, 1998

[51] Int. Cl.[7] ..... F24F 7/02; E04D 13/17

[52] U.S. Cl. ..... 52/95; 52/96; 52/97; 52/58; 52/302.1

[58] Field of Search ..... 52/95, 96, 97, 52/199, 302.1, 93.2, 58

[56] References Cited

U.S. PATENT DOCUMENTS

| | | | |
|---|---|---|---|
| D. 268,703 | 4/1983 | Lloyd-Jones . | |
| D. 316,299 | 4/1991 | Hurlburt . | |
| D. 361,138 | 8/1995 | Moore et al. . | |
| 1,427,412 | 8/1922 | Petersen . | |
| 2,111,251 | 3/1938 | Spilsbury . | |
| 2,896,559 | 7/1959 | Stephens . | |
| 3,415,019 | 12/1968 | Andersen . | |
| 3,436,877 | 4/1969 | Gunning . | |
| 3,815,302 | 6/1974 | Monroe . | |
| 3,826,048 | 7/1974 | Merkin et al. . | |
| 4,290,247 | 9/1981 | Alderman | 52/95 X |
| 4,347,691 | 9/1982 | Lloyd-Jones . | |
| 4,702,149 | 10/1987 | Speer | 52/95 X |
| 5,195,283 | 3/1993 | MacLead | 52/95 |
| 5,537,785 | 7/1996 | Zaccagni . | |
| 5,540,015 | 7/1996 | Anthony . | |
| 5,560,158 | 10/1996 | Norton . | |
| 5,711,117 | 1/1998 | Zaccagni et al. . | |
| 5,729,933 | 3/1998 | Strength . | |

*Primary Examiner*—Christopher T. Kent
*Attorney, Agent, or Firm*—Luedeka, Neely & Graham, PC

[57] ABSTRACT

Eave cladding which overlies the eave of a building, without overlying the roof of the building. A vertical portion, having a top, bottom, interior face, and exterior face overlies a sub-fascia, with a top and bottom. The interior face of the vertical portion is disposed adjacent the sub-fascia. The top of the vertical portion extends at most to the top of the sub-fascia, and the bottom of the vertical portion extends past the bottom of the sub-fascia. A horizontal lip is disposed at the top of the vertical portion, and forms a ninety degree angle with the vertical portion. The horizontal lip extends outwards from the exterior face of the vertical portion. An underlying portion is disposed at the bottom of the vertical portion, and forms a ninety degree angle with the vertical portion. The underlying portion extends inwards from the interior face of the vertical portion. A riser portion, having a top and bottom, is disposed with the bottom of the riser portion adjacent the underlying portion, and forms a ninety degree angle with the underlying portion. The bottom of the vertical portion, the underlying portion, and the riser portion form a drip edge. A horizontal portion, having an interior face, exterior face, inner end, and outer end, is disposed with the outer end of the horizontal portion adjacent the top of the riser portion, and forms a ninety degree angle with the riser portion. The horizontal portion underlies a sub-soffit, having an inner and outer ends, with the interior face of the horizontal portion disposed adjacent the sub-soffit. The outer end of the horizontal portion extends at most to the outer end of the sub-soffit, and the inner end of the horizontal portion extends to the inner end of the sub-soffit.

20 Claims, 3 Drawing Sheets

EAVE CLADDING

FIELD

This invention relates to building construction materials. More particularly the invention relates to an eave construction system.

BACKGROUND

The eave of a building is that portion which extends from just below the edge at the bottom of the roof to the top of the exterior wall. Typically, the roof will extend out past the exterior wall, and form an overhang. A vertical board, called a fascia board, usually extends down from the edge of the roof and connects to a soffit, which extends horizontally from the fascia board to the exterior wall.

Because the eave can be a focal point of the building construction, the appearance of the eave can have a dramatic impact on the overall appearance of the building. In other words, if the eave appears worn or dilapidated, or has the appearance of being constructed in an unprofessional manner, then the entire building tends to have a diminished appearance. In addition, the material used to construct the eave is exposed in some measure to the elements, and should be weather resistant, so as to protect the building materials which it overlies.

Unfortunately, building materials generally used to construct the eave tend to wear out over time as they are exposed to the elements, reducing the appearance of the building as described above. Thus, it is often desirable to refurbish the eave after some length of time. This can be very expensive, both in regard to the cost of the refurbishing materials and in the labor required to remove the old eave and install the new eave.

In addition, it can be quite difficult to construct an eave so that it has a good appearance. For example, one aspect of a well constructed eave that tends to be difficult to attain is a smooth, straight line along the eave at the point where the fascia meets the soffit. Inadequately constructed eaves tend to warp, bow, or ripple along this line, generally distracting from the symmetry of the building and giving the entire building the appearance of being poorly constructed.

What is needed therefore, is an eave construction system, or cladding, that is inexpensive and durable. Further, an eave cladding is needed that is easily installed, in that a person of average skill can construct an eave with smooth, straight lines, improving the general appearance of the building. In addition, an eave cladding is needed that can be used to overlie existing eave construction, without the need to remove the existing construction, such as the soffit, fascia, or roofing.

SUMMARY

The above and other needs are met by an eave cladding which overlies the eave of a building, without overlying the roof of the building. A vertical portion, having a top, bottom, interior face, and exterior face overlies a sub-fascia, with a top and bottom. The interior face of the vertical portion is disposed adjacent the sub-fascia. The top of the vertical portion extends at most to the top of the sub-fascia, and the bottom of the vertical portion extends past the bottom of the sub-fascia.

A horizontal lip is disposed at the top of the vertical portion, and forms a ninety degree angle with the vertical portion. The horizontal lip extends outwards from the exterior face of the vertical portion. An underlying portion is disposed at the bottom of the vertical portion, and forms a ninety degree angle with the vertical portion. The underlying portion extends inwards from the interior face of the vertical portion. A riser portion, having a top and bottom, is disposed with the bottom of the riser portion adjacent the underlying portion, and forms a ninety degree angle with the underlying portion. The bottom of the vertical portion, the underlying portion, and the riser portion form a drip edge.

A horizontal portion, having an interior face, exterior face, inner end, and outer end, is disposed with the outer end of the horizontal portion adjacent the top of the riser portion, and forms a ninety degree angle with the riser portion. The horizontal portion underlies a sub-soffit, having inner and outer ends, with the interior face of the horizontal portion disposed adjacent the sub-soffit. The outer end of the horizontal portion extends at most to the outer end of the sub-soffit, and the inner end of the horizontal portion extends to the inner end of the sub-soffit.

Because the horizontal lip projects outward from the vertical portion, the eave cladding may be placed over the top of an existing eave construction, without tearing up and removing the roof of the building. Further, by projecting outward from the vertical portion, the horizontal lip can underlie shingles which may extend off of the edge of the roof. Further, the lip prevents the water which runs off of the roof from splashing back underneath the shingles, and rotting the roof. Additionally, the drip edge formed by the vertical, underlying, and riser portions can fit over the projecting edge of an existing fascia board, thus allowing the eave cladding to be used without removing an existing fascia board. Further, the vertical and horizontal portions form an integrated fascia and soffit with a smooth, straight line that is easy to install.

In various preferred embodiments, a vertical lip is disposed at the inner end of the horizontal portions, and forms a ninety degree angle with the horizontal portion. The vertical lip extends downwards from the exterior face of the vertical portion, and provides an attachment point for the eave cladding. The horizontal portion also has a ridge disposed between and parallel to the outer and inner ends of the horizontal portion. A panel portion is disposed between the riser portion and the ridge, and a venting portion is disposed between the ridge and the inner end of the horizontal portion. The ridge provides rigidity for the eave cladding, and the venting portion allows air to circulate under the eave of the building and ventilate an attic under the roof. The panel portion helps maintain the structure integrity of the eave cladding. Therefore, the eave cladding can be formed in relatively long lengths of as great as sixty feet or more, which makes constructing an eave with smooth, straight lines even easier, when using a preferred embodiment of the present invention.

BRIEF DESCRIPTION OF THE DRAWINGS

Further advantages of the invention will become apparent by reference to the detailed description when considered in conjunction with the figures, which are not to scale, wherein like reference numbers indicate like elements throughout the several views, and wherein.

DETAILED DESCRIPTION

Figure 1:
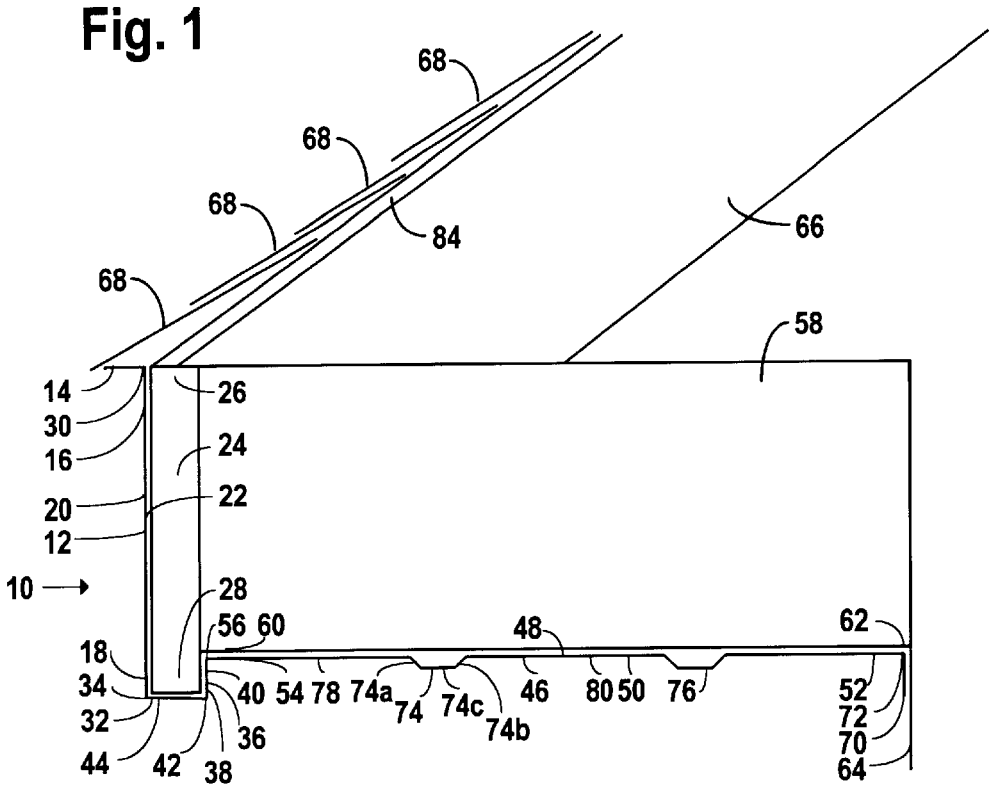
FIG. 1 is a cross-sectional view of an eave cladding without a gutter.

Referring now to FIG. 1, there is depicted a cross-sectional view of an eave cladding 10 according to the present invention. The eave cladding 10 may be used to form the fascia and soffit of a new building that is being constructed, or may be placed so as to overlie the existing eave construction of an older building. The eave cladding 10 has a vertical portion 12 and a horizontal portion 46. The vertical portion 12 corresponds generally to the fascia portion of the eave cladding 10, and the horizontal portion 46 corresponds generally to the soffit portion of the eave cladding 10.

The eave cladding 10 may be formed of a variety of materials having properties compatible with at least some of the purposes and desired properties of the eave cladding 10. For example, the eave cladding 10 is designed to protect the eave construction of a building from water, sun, and other natural elements. Thus, the material used to form the eave cladding 10 is preferably at least water resistant, if not water repellant, and has good tolerance to ultraviolet light damage. In addition, as the eave cladding 10 may be used to provide decoration to the eave construction of the building, the eave cladding 10 is preferably formed of a material that will adequately hold the shape given it, and not deform too easily, so that it retains its intended shape.

Further, the material for the eave cladding 10 will preferably accept a painted coating, or be able to be colored in some other manner, so that the color of the eave cladding 10 can be chosen to match or compliment the other colors used for the exterior of the building. The material chosen should also be sufficiently durable to withstand the physical stresses of moderate impacts that may occur from time to time, and also to not tear free from the fasteners which connect it to the eave construction which it overlies. Metals, such as steel or aluminum, or durable polymers, such as vinyl, are good materials for use in constructing the eave cladding 10.

Figure 3:
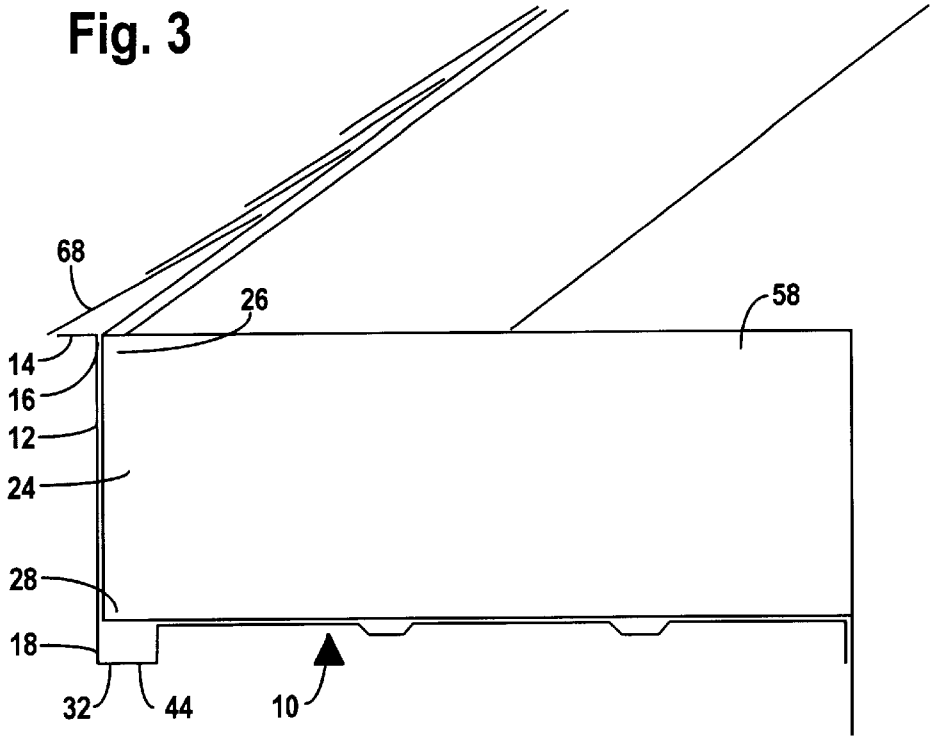
FIG. 3 is a cross-sectional view of an eave cladding without a fascia board.

The eave cladding 10 is brought up under the eave of the building, such that the interior face 22 of the vertical portion 12 is disposed adjacent the sub-fascia 24. When the eave cladding 10 is used with existing eave construction, the sub-fascia 24 may be material such as a nominally one inch thick board. In new construction, the sub-fascia 24 may also be a one inch thick board, or may be the ends of the sub-soffit 58, which may be ceiling joists which are open on the ends, such as depicted in FIG. 3. The width of vertical portion 12, which is defined to be the distance between the top end 16 and bottom end 18 of the vertical portion 12, is preferably great enough to completely cover the sub-fascia 24, which is typically between about four inches and about two feet, and most preferably about seven inches. This width is selected in part to completely cover the existing sub-fascia 24 as depicted in FIG. 1, or sub-soffit 58 as depicted in FIG. 3.

The top 16 of the vertical portion 12 extends at most to the top 26 of the sub-fascia 24. At the top 16 of the vertical portion 12 is a horizontal lip 14, which forms a ninety degree angle 30 with the vertical portion 12. The horizontal lip 14 extends from the exterior face 20 of the vertical portion 12, such that the horizontal lip 14 extends away from the sub-fascia 24. In this manner, the horizontal lip 14 is either preferably at or just below the top 26 of the sub-fascia 24.

Because the horizontal lip 14 extends outwards, instead of inwards under the roofing 68, the eave cladding 10 can be used to overlie existing eave construction, without overlying the roof portion 84 of the building. Because there is no part of the eave cladding 10 which overlies the roof portion 84 of the building, there is no need to remove any of the roofing 68, such as shingles, in order to install the eave cladding 10. This results in dramatic cost savings in the use of the eave cladding 10, such as by saving the cost of additional roofing material 68 to replace that which would otherwise need to be torn up, and the cost of the labor to accomplish the additional work.

Figure 2:
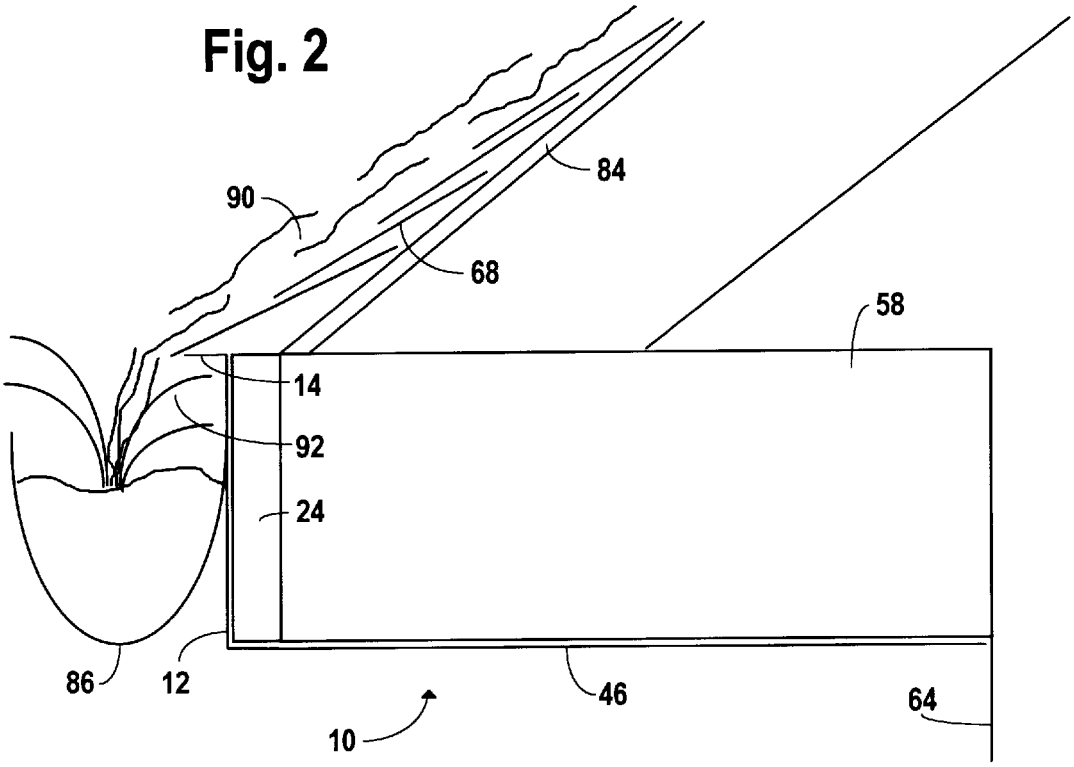
FIG. 2 is a cross-sectional view of an eave cladding with a gutter.

However, the horizontal lip 14 provides other benefits to the eave cladding 10 as well. For example, the particular construction of the horizontal lip 14 tends to prevent water from traveling underneath the roofing 68 and rotting the roof portion 84, or otherwise entering and damaging the building. One way in which water could otherwise travel under the roofing 68, is when a rain gutter 86 is attached to the exterior face 20 of the vertical portion 12 as depicted in FIG. 2, or if the eave cladding 10 is not used, directly to the sub-fascia 24. During a rain storm, water 90 tends to travel down the slope of the roof on top of the roofing 68. The water 90 picks up velocity as it runs down the roof, until is reaches the end of the roof and cascades into the rain gutter 86.

The velocity of the water 90 at the point at which it enters the rain gutter 86 is often sufficient to cause a splattering effect, which splashes water 92 back towards the roofing 68. Because the rain gutter 86 is typically disposed at an elevation which is below that of the end of the roofing 68, the water 92 splashed back towards the roofing 68 will tend to travel at an angle and from a direction which will direct the water 92 underneath the roofing 68. This condition can, during a heavy rain storm or over a great enough period of time, cause damage to the roofing portion 84 or other elements of the building.

With the eave cladding 10 in place, however, the horizontal lip 14 extends outward underneath the roofing 68 and prevents the splashing water 92 from penetrating under the roofing 68. Thus, the location and direction of projection of the horizontal lip 14 provide important benefits to the eave cladding 10. Preferably, the horizontal lip 14 has a width of between about one-quarter inch and about one inch, and most preferably has a width of about one-half inch. The width of the horizontal lip 14 is selected in part to allow the horizontal lip 14 to extend far enough away from the vertical portion 12 to adequately prevent water 92 from splashing back underneath the roofing 68, while at the same time not being too wide as to detrimentally effect the angle at which the roofing 68 rests upon the horizontal lip 14. For example, if the angle of the roofing 68 is too shallow, such as would occur if the horizontal lip 14 were too wide, then water may tend to travel back up and underneath the edges of the roofing 68, instead of running off of the exposed upper face of the roofing 68.

The ninety degree angle 30 between the horizontal lip 14 and the vertical portion 12 is selected in part as a balance between the competing interests of not detrimentally effecting the angle at which the roofing 68 rests upon the horizontal lip 14, as explained above, and providing an adequate barrier to the splashing water 92, also as explained above. For example, if the angle between the horizontal lip 14 and the vertical portion 12 was greater than ninety degrees, the free end of the horizontal lip 14 would be disposed at a relatively higher elevation, and may tend to more effectively prevent water 92 from splashing up under the roofing 68 from the rain gutter 86. However, this greater angle 30 would also tend to cause the roofing 68 to lie in a flatter orientation. At this shallower pitch, water 90 running down the roofing 68 may tend to creep back up between the roofing 68, rather than run down the roofing 68 to the rain gutter 86. This may result in the roof portion 84 rotting, or otherwise damaging the building as described above.

Conversely, if the angle 30 was less than a ninety degree angle, then the free end of the horizontal lip 14 would be disposed at a relatively lower elevation, and the roofing 68 would tend to lie at a steeper angle, thus helping to alleviate the problem with water 90 backing up under the roofing 68. However, the horizontal lip 14 would also present less of a barrier to the splashing water 92 in this configuration, and thus would tend to not be as effective at preventing the splashing water 92 from penetrating under the roofing 68 and damaging the roof portion 84 of the building. Thus, the ninety degree angle 30 is preferably selected as an optimum balance between these competing interests.

Referring again to FIG. 1, the bottom 18 of the vertical portion 12 of the eave cladding 10 extends past the bottom 28 of the sub-fascia 24, and forms a ninety degree angle 34 with an underlying portion 32, which extends inwards from the interior face 22 of the vertical portion 12. The underlying portion 32 extends for a width that is at least as wide as the width of the an existing fascia board, if any. Preferably the underlying portion 32 has a width of between about one-half inch and two inches, and is most preferably about one inch in width.

The underlying portion 32 is disposed adjacent the bottom 38 of a riser portion 36, and forms a ninety degree angle 42 with the riser portion 36. The riser portion 36 comes up behind the interior face of a fascia board that may be a part of the sub-fascia 24. In the preferred embodiment, the riser portion 36 has width, as measured between the bottom 38 of the riser portion 36 and the top 40 of the riser portion 36, of between about one-half inch and about two inches, and most preferably about one inch in width. The width of the riser portion 36 is selected in part to allow the eave cladding 10 to underlie and protect the bottom 28 of the sub-fascia 24, while the horizontal portion 46 of the eave cladding 10 may be brought up in close proximity to the sub-soffit 58.

In addition, the riser portion 36, underlying portion 32, and the bottom 18 of the vertical portion 12 form a drip edge 44, that provides substantial benefits to the eave cladding 10. For example, and especially in the case when the eave cladding 10 is used without a rain gutter, any water traveling down the exterior face 20 of the vertical portion 12 will tend to run off of the drip edge 44. In some cases, this amount of water can be quite great, as water running down the slope of roofing 68 may curl around and run down the exterior face 20 of the vertical portion 12. If the drip edge 44 were not provided, the water may curl around the bottom 18 of the vertical portion 12 and come up into the building through the sub-soffit 58, or elsewhere under the eave of the building. Alternately, the water may travel inwards across the width of the horizontal portion 46, and travel down the wall 64, possibly causing damage to the wall 64. Thus, the drip edge 44 of the eave cladding 10 is of great utility.

The dimensions of the drip edge 44, as given above, are preferably selected, at least in part, to accommodate the dimensions of the sub fascia 24. For example, the ninety degree angle 34 between the vertical portion 12 and the underlying portion 32, and the ninety degree angle 42 between the underlying portion 32 and the riser portion 36, are selected in part because some fascia boards used in eave construction have ninety degree angles at this location. However, these angles 34 and 42 could be modified to fit the particular configurations of other fascia boards. Alternately, one of the angles 34 or 42 could be greater than ninety degrees and the other of the angles 42 or 34 could be shallower than ninety degrees, and the drip edge 44 could still be configured to fit around a fascia board.

In addition, the preferred one inch nominal width for each of the underlying portion 32 and the riser portion 36 is selected so as to fit snugly about some fascia boards. Some fascia boards are made of one inch thick stock with a seven inch width. The fascia board may be fastened to the ends of the ceiling joists, which are nominally six inches in width. Often, the top of the seven inch fascia board will fit flush with the top of the six inch ceiling joists. Thus, in this configuration, the bottom of the fascia board will extend about one inch past the bottom of the ceiling joists. The dimensions of the drip edge 44, as described above, allow the eave cladding 10 of the preferred embodiment to closely cover this eave configuration. By doing so, the underlying portion 32 of the drip edge 44 provides a convenient attachment point to the sub-fascia 24, if so desired. However, if an attachment point is not required at this position, then the drip edge 44 may have configurations of angles and widths other than that as described above.

The top 40 of the riser portion 36 is disposed adjacent the outer end 60 of the horizontal portion 46, and forms a ninety degree angle 56 with the horizontal portion 46. This angle 56 is also preferably selected, at least in part, based on the same types of considerations mentioned above for the configuration of the drip edge 44. The interior face 48 of the horizontal portion 46 is disposed adjacent the sub-soffit 58. In a building that already has some type of eave construction, the sub-soffit 58 may be an existing soffit. In a newly constructed building, the sub-soffit 58 may be the underside of the ceiling joists, as depicted in FIG. 3. The outer end 54 of the horizontal portion 46 extends at most to the outer end 60 of the sub-soffit 58. The inner end 52 of the horizontal portion 46 extends to the inner end 62 of the sub-soffit. Thus, the inner end 52 of the horizontal portion 46 extends to the wall 64.

Preferably, the horizontal portion 46 has a width, which is defined as the distance between the outer end 54 of the horizontal portion 46 and the inner end 52 of the horizontal portion 46, of between about six inches and four feet, and most preferably a width of from about one foot to about two feet. The width of the horizontal portion 46 is selected to as to extend from the inner face of the sub-fascia 24, if the sub-fascia 24 exists, to the wall 64. In this manner, the entire area of the sub-soffit 58 is covered by the eave cladding 10 and protected from the environment. Further, by having a width selected in this manner, the horizontal portion 46 does not buckle or crimp by having too great a width to easily fit between the outer end 60 of the sub-soffit 58 and the inner end 62 of the sub-soffit 58.

In the case where there is no existing eave construction prior to the placement of the eave cladding 10, or in the case where the prior eave construction either does not use a sub-fascia 24, or the sub-soffit 58 extends outwards past the sub-fascia 24, the horizontal portion 46 does not extend to the outer end 60 of the sub-soffit 58. Instead, the outer end 54 of the horizontal portion 46 extends to a position along the sub-soffit 58 such that, given the additional width of the underlying portion 32, the interior 22 of the vertical portion 12 fits flush with and adjacent the sub-fascia 24 or the outer ends 60 of the sub-soffit 58, as depicted in FIG. 3. Thus, even when the drip edge 44 is not required to fit around the bottom 18 of the sub-fascia 12, the drip edge 44 is still present so as to provide the additional benefits as described above.

In a preferred embodiment, a vertical lip 70 is disposed adjacent the inner end 52 of the horizontal portion 46, and forms a ninety degree angle 72 with the horizontal portion 46. The angle 72 is selected, at least in part, to coincide with the typical configuration between the sub-soffit 58 and the wall 64, which usually form a ninety degree angle. However, the angle 72 could be selected to coincide with a different degree of angle formed between the sub-soffit 58 and the wall 64. Alternately, the angle 72 could be less than ninety degrees, and thus not lie flat against the wall 64. This configuration may provide an additional location were the path of water can be diverted away from the wall 64. However, the preferred angle 72 of ninety degrees provides a smooth, straight appearance to the eave cladding 10 as installed, and also provides a convenient attachment point for the eave cladding 10, as described in more detail below.

The vertical lip 70 extends downward from the exterior face 50 of the horizontal portion 46, and thus extends a distance along the wall 64. The vertical lip 70 preferably has a width, which is defined to be the distance between the point on the vertical lip 70 adjacent the inner end 52 of the horizontal portion 46 and the free end at the bottom of the vertical lip 70, of between about one-quarter inch and about two inches, and most preferably about one inch. The width of the vertical lip 70 is selected in part to provide adequate space to secure a fastener through the vertical lip 70 and into the wall 64, thus providing an attachment point for the eave cladding 10. The attachment point in the vertical lip 70 may be used in place of, or in addition to the attachment point at the inner end 52 of the horizontal portion 46.

The eave cladding 10 preferably has a first ridge 74 in the horizontal portion 46. The first ridge 74 is disposed between and is parallel to the outer end 54 of the horizontal portion 46 and the inner end 52 of the horizontal portion 46. FIG. 1 depicts a most preferred embodiment, where the first ridge 74 extends below the exterior surface 50 of the horizontal portion 46. In alternate embodiments, the first ridge 74 may extend upwards from the interior surface 48 of the horizontal portion 46. In this alternate embodiment, the highest portion of the first ridge 74, and any other ridges formed in the same manner as the first ridge 74, would comprise that portion of the interior face 48 of the horizontal portion 46 that would be adjacent the sub-soffit 58, and would provide optional connection points between the eave cladding 10 and the sub-soffit 58.

The position along the width of the horizontal portion 46 and the size and construction of the first ridge 74 are selected in part to provide an amount of rigidity to the eave cladding 10. It will be appreciated that, although depicted in the figures primarily in cross-section, the eave cladding 10 extends down the length of the eave of a building. One of the benefits of the eave cladding 10 is that it can be made in very great lengths. Long material, such as this, tends to twist and bend along its length, under the influence of either its own weight or other factors, such as mishandling. The first ridge 74, and any other ridges which may be present in the eave cladding 10, are selected as to location, construction, and size so as to provide a degree of rigidity to the eave cladding 10, such that lengths of up to about sixty feet can be easily handled by a single person without the eave cladding 10 twisting, bending, or otherwise significantly deforming.

In an especially preferred embodiment, the first ridge 74 has side walls 74*a* and 74*b* that extend downward from the horizontal portion 46 at an angle and to a depth of approximately one-quarter inch below the exterior surface 50 of the horizontal portion 46. The sloping sidewalls 74*a* and 74*b* are joined at the bottom of the first ridge 74 by a bottom section 74*c* having a width of about one-quarter inch. Thus, the entire width of the first ridge 74 is, in this embodiment, about one-half inch. Preferably, the number of ridges along the width of the horizontal portion 46, such as the first ridge 74, increases as the width of the horizontal portion 46 increases, and decreases as the width of the horizontal portion 46 decreases. In other words, more ridges tend to be required to prevent a wider piece of eave cladding 10 from deforming, and fewer ridges tend to be required to prevent a narrower piece of eave cladding 10 from deforming. Of course, if the eave cladding 10 is narrow enough, or if deformation is otherwise determined to not be a problem, then the ridges may be altogether omitted.

Such an embodiment of the eave cladding 10, having no ridges, is depicted in FIG. 2. In this embodiment, the vertical portion 12 connects directly to the horizontal portion 46. Thus, there is no drip edge 44. Also removed from this embodiment is the vertical lip 70. This embodiment of the eave cladding 10 is designed for use such as to overlie an existing eave construction where the bottom of the sub-fascia 24 does not extend down past the bottom of the sub-soffit 58, or in new construction where the sub-fascia 24 and the sub-soffit 58 comprise the ends of the ceiling joists. However, in this embodiment, the horizontal lip 14 still projects outward from the exterior face 20 of the vertical portion 12, at an angle as described above, so that the existing roofing 68 does not need to be torn up to install the eave cladding 10, and the eave cladding 10 does not overlie the roof portion 84.

A panel portion 78 is preferably disposed between the outer end 54 of the horizontal portion 46 and the inner end 52 of the horizontal portion 46. In a most preferred embodiment, the panel portion 78 is disposed between the outer end 54 of the horizontal portion 46 and the first ridge 74. The panel portion 78 is so described because it does not have any preformed holes, voids, or perforations which extend entirely through the eave cladding 10 from the exterior surface 50 of the horizontal portion 46 to the interior surface 52 of the horizontal portion 46. However, the panel portion 78 is not necessary planar in configuration, but a pattern may be formed in the panel portion 78. The pattern may be a decorative type of recurring pattern stamped within the material of the eave cladding 10, such as may be created by roll-forming or embossing.

The panel portion 78 tends to provide additional rigidity and stability to the eave cladding 10, to help prevent it from bending, twisting, or otherwise seriously deforming. Thus, it is most preferably disposed at the outer end 54 of the horizontal portion 46, near the drip edge 44. In this manner, the panel portion 78 provides strength to a portion of the eave cladding 10 that might otherwise deform under the stresses induced between the opposing forces of the weight of the vertical portion 12 and the rest of the horizontal portion 46.

In various preferred embodiments the panel portion 78 extends for as much as the entire width of the horizontal portion 46. However, in especially preferred embodiments the panel portion 78 extends for a width of about three inches between the riser portion 36 and the first ridge 74. This width is selected in part to provide adequate rigidity and strength to the more common vertical portion 12 widths and horizontal portion 46 widths of the eave cladding 10.

Figure 4:
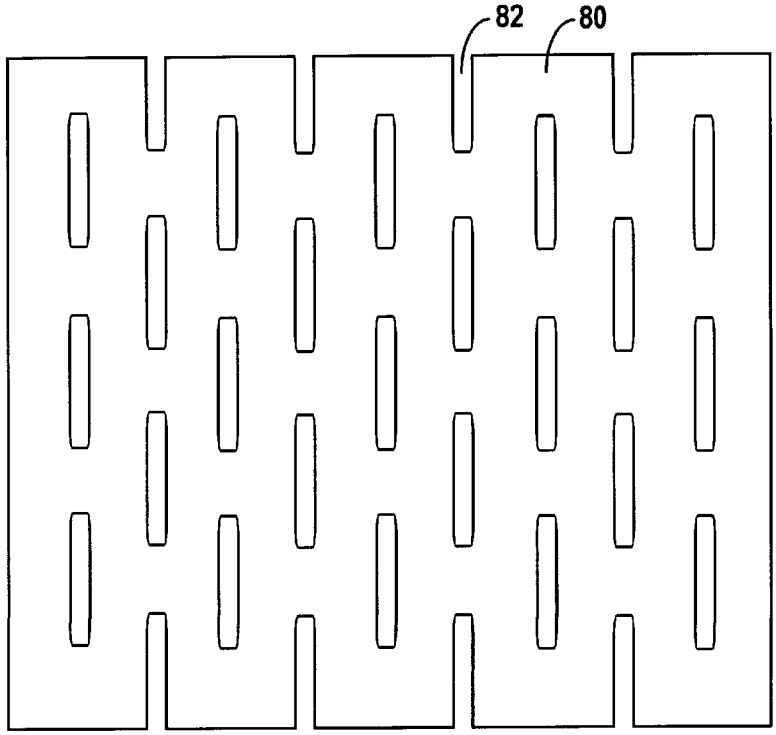
FIG. 4 is a bottom view of the detail of a venting portion.

A venting portion 80 is preferably disposed between the outer end 54 of the horizontal portion 46 and the inner end 52 of the horizontal portion 46. In a most preferred embodiment, the venting portion 80 is disposed between the first ridge 74 and the inner end 52 of the horizontal portion 46. The venting portion 80 is so described because it has perforations 82 which extend entirely through the eave cladding 10 from the exterior face 50 of the horizontal portion 46 to the interior face 48 of the horizontal portion 46, as depicted in FIG. 4. As depicted, the venting portion 80 has long slots 82 which extend along the length of the venting portion 80.

In alternate embodiments the perforations 82 may have other configurations, such as circular-shaped holes. However, preferably the perforations 82 are not so closely spaced or so great in size as to substantially or serious reduce the strength and rigidity of the eave cladding 10. Considerations in making this selection for the size, shape, and density of the perforations 82 include, but are not limited to, the type of material used to form the eave cladding 10, the width of the horizontal portion 46, the width of the vertical portion 12, and the number, location, and configuration of any ridges which may be present in the design.

The venting portion 80 tends to provide an area where air may freely flow through the eave cladding 10. In this manner, hot or stale air is allowed to flow out from the attic area of the building through the venting portion 80, thus helping cool the building and prevent mildew or other problems in the attic area. Thus, the venting portion 80 is most preferably disposed approximately midway between the outer end 54 of the horizontal portion 46 and the inner end 52 of the horizontal portion 46. In this manner, the venting portion 80 provides a more unobstructed path for the air to travel as in enters and exits the attic area.

In various preferred embodiments the venting portion 80 extends for as much as the entire width of the horizontal portion 46. However, in especially preferred embodiments the venting portion 80 extends for a width of about three inches between the first ridge 74 and the inner end 52 of the horizontal portion 46. This width is selected in part to provide adequate air flow through the eave cladding 10, while not seriously and detrimentally effecting the rigidity and strength of the eave cladding 10, given the more common vertical portion 12 widths and horizontal portion 46 widths.

The venting portion 80 may extend down the entire length of the horizontal portion 46. However, this amount of venting portion 80 may be more than what is needed to provide adequate ventilation to the attic area. In addition, and especially since this degree of ventilation may not be required, this amount of venting portion 80 may cause to reduce the ability of the eave cladding 10 to resist structural deformation, such as the bending and twisting described above. For some widths of eave cladding 10, this continuous length of venting portion 80 will not be a problem. However, for extremely wide widths of eave cladding 10, additional widths of panel portions 78, or additional ridges 74 may be required to compensate for the continuous length of venting portion 80.

In a most preferred embodiment, the perforations 82 of the venting portion 80 extend in a pattern down the eave cladding 10 for a length of about twelve inches. This length is then followed by a section without any perforations 82, and then the perforations 82 extend in a pattern for another twelve inches down the length of the eave cladding 10. Thus, the perforations 82 are preferably disposed in twelve inch long patterns that are interdigitated with lengths of from about one inch to about twenty-four inches where no perforations 82 exist. In this manner, an adequate degree of ventilation is provided for most circumstances, while also providing an adequate degree of strength and rigidity to the eave cladding 10.

A second ridge 76 is preferably disposed in the horizontal portion 46. The second ridge 76 may be configured in a manner identical to that of the first ridge 74, or may be otherwise formed according to the design criteria as given above. In a most preferred embodiment, the venting portion 80 is disposed between and extends for a width of about three inches between the first ridge 74 and the second ridge 76. The width between the first ridge 74 and the second ridge 76 may also be three inches, the preferred width of the venting portion 80, or may extend for a greater width than this dimension. In a most preferred embodiment, the width between the first ridge 74 and the second ridge 76 is about four and one-half inches.

The eave cladding 10 may be attached to the building with a nail, screw, adhesive, or other suitable fastener. A suitable fastener is one which is compatible with the material behind the eave cladding 10, such as the wall 64, sub-soffit 58, and sub-fascia 24, and which is relatively resistant to weather effects. The eave cladding 10 can be attached at any one or more of several positions along the eave cladding 10. For example, fasteners as described above can be placed along the ridges 74 or 76, in the panel portion 78, in the venting portion 80, in any one of the three surfaces of the drip edge 44, or at any point along the exterior face 20 of the vertical portion 12. In the preferred embodiment, fasteners are place at the top 16 of the vertical portion 12, just below the horizontal lip 14, and in the vertical lip 70.

Figure 5:
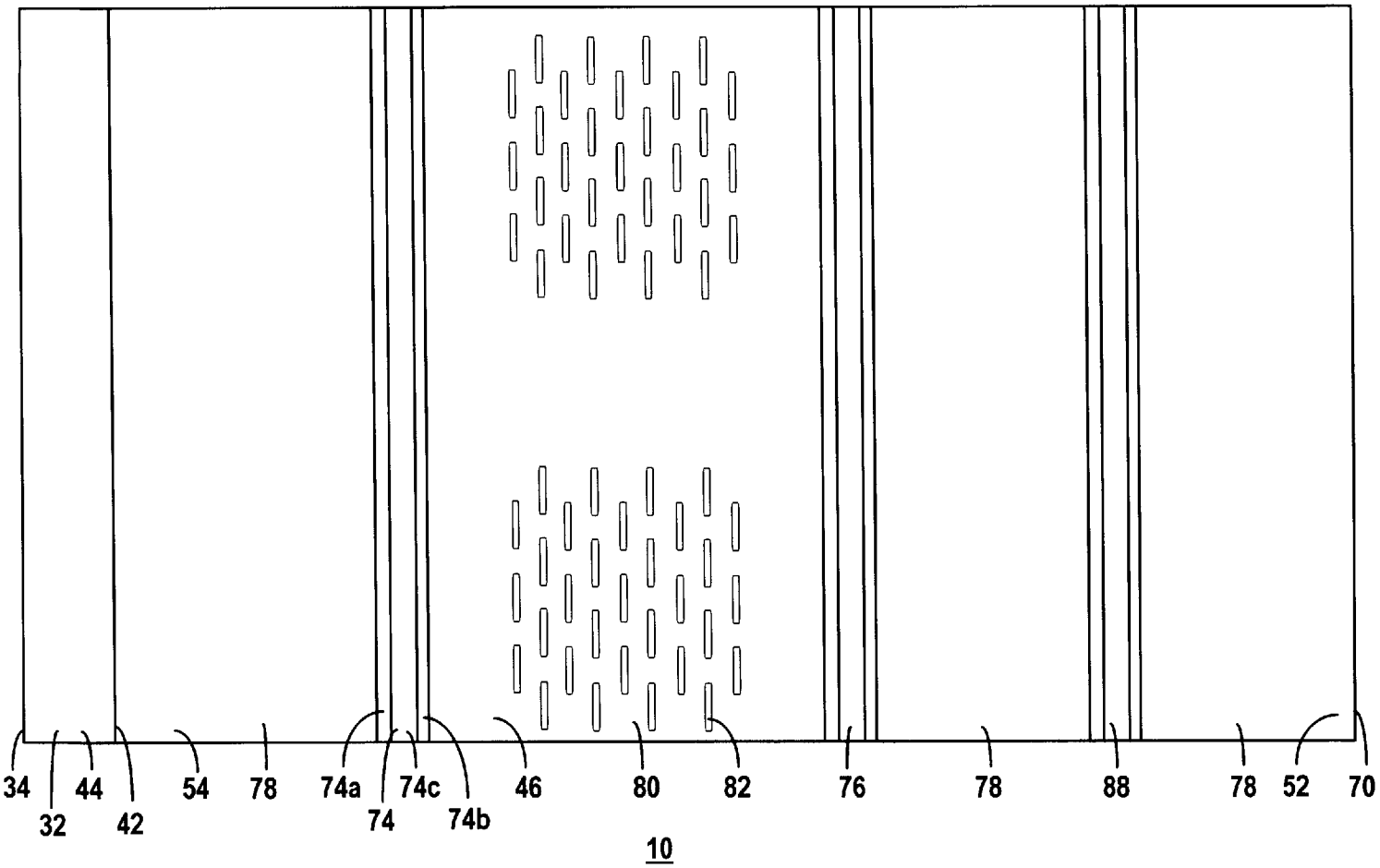
FIG. 5 is a bottom view of the horizontal portion of an eave cladding.

FIG. 5 depicts the bottom view of an eave cladding 10, looking up toward the exterior face 50 of the horizontal portion 46, with the outer end 54 of the horizontal portion 46 toward the left-hand side of the figure, and the inner end 52 of the horizontal portion 46 toward the right-hand side of the figure. As can be seen, the venting portion 80, in this embodiment, is disposed between the first ridge 74 and the second ridge 76. The venting portion 80 has patterns of perforations 82 that are grouped into patterns between the first ridge 74 and the second ridge 76. Further, the patterns of perforations 82 are not continuous down the length of the eave cladding 10, but are interdigitated with nonperforated sections of the venting portion 80.

Also in this embodiment, a third ridge 88 is disposed in the horizontal portion 46, between the second ridge 76 and the inner end 52 of the horizontal portion 46. In this embodiment as depicted, the areas of the eave cladding 10 that are adjacent and disposed on either side of the third ridge 88 are panel portions 78. However, in alternate embodiments, one or more of these other areas could also be venting portions 80, or have some other configuration other than that described above for the panel portion 78 or the venting portion 80. In addition, in other embodiments there could be a greater or lesser number of ridges 74, 76, and 88, which would create additional areas between ridges. These areas could also be formed of the panel portions 78 or venting portions 80 as described above.

It will be appreciated that the invention as described above comprehends adaptation, rearrangement, and substitution of parts, all of which would be considered to be within the scope and spirit of the invention as described, and that the scope of the invention is only to be restricted by the language of the claims given below.

What is claimed is:

1. Eave cladding for overlying an eave of a building without overlying a roof portion of the building, the eave cladding comprising:

a vertical portion having a top, a bottom, an interior face, and an exterior face, the vertical portion for overlying a sub-fascia having a top and a bottom, with the interior face of the vertical portion for being disposed adjacent the sub-fascia, the top of the vertical portion for extending at most to the top of the sub-fascia, and the bottom of the vertical portion for extending past the bottom of the sub-fascia, a horizontal lip disposed at the top of the vertical portion and forming a ninety degree angle with the vertical portion, the horizontal lip extending outwards from the exterior face of the vertical portion, an underlying portion disposed at the bottom of the vertical portion and forming a ninety degree angle with the vertical portion, the underlying portion extending inwards from the interior face of the horizontal portion, a riser portion having a top and a bottom, the bottom of the riser portion disposed adjacent the underlying portion and forming a ninety degree angle with the underlying portion, the bottom of the vertical portion, the underlying portion, and the riser portion forming a drip edge, and a horizontal portion having an interior face, an exterior face, an inner end, and an outer end, the outer end of the horizontal portion disposed adjacent the top of the riser portion and forming a ninety degree angle with the riser portion, the horizontal portion for underlying a sub-soffit having an inner end and an outer end, the interior face of the horizontal portion for being disposed adjacent the sub-soffit, the outer end of the horizontal portion for extending at most to the outer end of the sub-soffit, and the inner end of the horizontal portion for extending to the inner end of the sub-soffit.

2. The eave cladding of claim 1, further comprising a vertical lip disposed at the inner end of the horizontal portion and forming a ninety degree angle with the horizontal portion, the vertical lip extending downwards from the exterior face of the vertical portion.

3. The eave cladding of claim 2, wherein the vertical lip has a width of one inch.

4. The eave cladding of claim 1, wherein the horizontal lip has a width of one-half inch.

5. The eave cladding of claim 1, wherein the vertical portion has a width of seven inches.

6. The eave cladding of claim 1, wherein the underlying portion has a width of one inch.

7. The eave cladding of claim 1, wherein the riser portion has a width of one inch.

8. The eave cladding of claim 1, wherein the horizontal portion has a width of from one foot to two feet.

9. The eave cladding of claim 1, wherein the horizontal portion further comprises a ridge disposed between and parallel to the outer end of the horizontal portion and the inner end of the horizontal portion.

10. The eave cladding of claim 9, wherein the ridge has a depth of one-quarter inch and a width of one-half inch.

11. The eave cladding of claim 1, wherein the horizontal portion further comprises a panel portion disposed between the outer end of the horizontal portion and the inner end of the horizontal portion.

12. The eave cladding of claim 1, wherein the horizontal portion further comprises a venting portion disposed between the outer end of the horizontal portion and the inner end of the horizontal portion.

13. The eave cladding of claim 1, wherein the horizontal portion further comprises:

a ridge disposed between and parallel to the outer end of the horizontal portion and the inner end of the horizontal portion, a panel portion disposed between the riser portion and the ridge, and a venting portion disposed between the ridge and the inner end of the horizontal portion.

14. The eave cladding of claim 13, wherein the panel portion extends for a width of three inches between the riser portion and the ridge.

15. The eave cladding of claim 13, wherein the venting portion extends for a width of three inches between the ridge and the inner end of the horizontal portion.

16. Eave cladding for overlying an eave of a building without overlying a roof portion of the building, the eave cladding comprising:

a vertical portion having a top, a bottom, an interior face, and an exterior face, the vertical portion for overlying a sub-fascia having a top and a bottom, with the interior face of the vertical portion for being disposed adjacent the sub-fascia, the top of the vertical portion for extending at most to the top of the sub-fascia, and the bottom of the vertical portion for extending past the bottom of the sub-fascia, a horizontal lip disposed at the top of the vertical portion and forming a ninety degree angle with the vertical portion, the horizontal lip extending outwards from the exterior face of the vertical portion, an underlying portion disposed at the bottom of the vertical portion and forming a ninety degree angle with the vertical portion, the underlying portion extending inwards from the interior face of the horizontal portion, a riser portion having a top and a bottom, the bottom of the riser portion disposed adjacent the underlying portion and forming a ninety degree angle with the underlying portion, the bottom of the vertical portion, the underlying portion, and the riser portion forming a drip edge, a horizontal portion having an interior face, an exterior face, an inner end, and an outer end, the outer end of the horizontal portion disposed adjacent the top of the riser portion and forming a ninety degree angle with the riser portion, the horizontal portion for underlying a sub-soffit having an inner end and an outer end, the interior face of the horizontal portion for being disposed adjacent the sub-soffit, the outer end of the horizontal portion for extending at most to the outer end of the sub-soffit, and the inner end of the horizontal portion for extending to the inner end of the sub-soffit, the horizontal portion further having;

ridges disposed between and parallel to the outer end of the horizontal portion and the inner end of the horizontal portion, a panel portion disposed between the riser portion and a first of the ridges, and a venting portion disposed between the first of the ridges and the inner end of the horizontal portion; and a vertical lip disposed at the inner end of the horizontal portion and forming a ninety degree angle with the horizontal portion, the vertical lip extending downwards from the exterior face of the vertical portion.

17. The eave cladding of claim 16, further comprising:

the panel portion extending for a width of three inches between the riser portion and the first of the ridges, and the venting portion extending for a width of three inches between the first of the ridges and a second of the ridges.

18. The eave cladding of claim 16, wherein the eave cladding is made of steel.

19. The eave cladding of claim 16, wherein the eave cladding is made of a durable polymer.

20. Eave cladding for overlying an eave of a building without overlying a roof portion of the building, the eave cladding comprising:

a vertical portion having a top, a bottom, an interior face, and an exterior face, the vertical portion for overlying a sub-fascia having a top and a bottom, with the interior face of the vertical portion for being disposed adjacent the sub-fascia, a horizontal lip disposed at the top of the vertical portion and extending outwards from the exterior face of the vertical portion, for being disposed adjacent the top of the sub-fascia and for extending outwards from the top of the sub-fascia, and a horizontal portion having an interior face and an outer end, the outer end of the horizontal portion disposed adjacent the bottom of the vertical portion, the horizontal portion for underlying a sub-soffit, with the interior face of the horizontal portion for being disposed adjacent the sub-soffit.

* * * * *